United States Patent [19]

Lowrance

[11] Patent Number: 5,012,458

[45] Date of Patent: Apr. 30, 1991

[54] RACING GATE FOR KITES

[76] Inventor: Arlen J. Lowrance, 7655 E. 41st St., Tulsa, Okla. 74145

[21] Appl. No.: 402,653

[22] Filed: Sep. 5, 1989

[51] Int. Cl.[5] ..... G04B 47/00; A63H 27/08

[52] U.S. Cl. ..... 368/10; 244/155 R

[58] Field of Search ..... 368/10, 11, 14; 244/155 R, 155 A; 73/186–189, 861.74–861.76

[56] References Cited

U.S. PATENT DOCUMENTS

| | | | |
|---|---|---|---|
| 2,491,176 | 12/1949 | Hammond | 73/189 |
| 3,277,706 | 10/1966 | Godet | 73/189 |
| 3,338,536 | 8/1967 | Hull et al. | 244/155 A |
| 4,454,757 | 6/1984 | Weinstein et al. | 73/861.76 |
| 4,864,854 | 9/1989 | vanLeemput | 73/189 |

*Primary Examiner*—Vit W. Miska

*Attorney, Agent, or Firm*—William S. Dorman

[57] ABSTRACT

A racing gate for a kite comprising an essentially vertical pipe supported at the lower end on the ground. An elongated wand is pivotally mounted adjacent to the upper end of the pipe and has an upper end which projects into the path of a moving kite, or more accurately into the path of the moving strings of a kite. The lower end of the wand below the pivot point is resiliently attached to the pipe so that, when the wand is pivoted by the horizontal movement of a kite string against the upper end of the wand, the wand will return to its upright position after the kite string passes by. An electrically operated timer, such as a stopwatch, is connected to the pipe. The electrical leads for the timer pass upwardly through the pipe and one of the leads is electrically connected to a conductive sleeve mounted on the wand. The other lead is connected to a second electrically conductive sleeve which is mounted on the pipe in such a position that the first sleeve will contact the second sleeve when the wand is pivoted in a given rotary direction. The resilient attachment is preferably mounted in such a way that the wand is offset slightly from the vertical to prevent accidental contact between the two sleeves under conditions of backlash.

6 Claims, 2 Drawing Sheets

RACING GATE FOR KITES

BACKGROUND OF THE INVENTION

1. Field of the Invention

The present invention relates to a device which can be employed as a racing gate. More particularly, the present invention relates to a racing gate which is actuated by the kite string or kite strings of a horizontally moving kite.

2. The Prior Art

The sport of racing kites is becoming increasing popular. There is one form of kite, sometimes referred to as a delta-wing kite, which is mounted on the end of a pair of kite lines, as opposed to a single kite line for the more conventional type of kite. When the delta kite is in the air, the two lines will extend downwardly to the ground where they are held, separately, in the hands of the operator. Without discussing the theory under which these double line kites operate, a skilled operator, by controlling the lines individually can make these kites perform feats which are not normally possible with a conventional single line kite. It is possible, for example, with these delta-wing kites, after they have been launched in the air, to move these kites in a horizontal direction, at a great rate of speed where the kite is moving, as it were, on a knife edge.

In racing these delta-wing kites horizontally, it has become a practice of late to run these kites competitively through different horizontal and vertical patterns and to record the time required for each kite to transverse a given course. Thus, it can be said that there is a sport of kite racing.

At the present time the method of "timing" a kite over a predetermined course is by a stopwatch and visual observation (estimation) as to when the kite begins and finishes the course.

As far as the present inventor is aware there are no gates which can be deflected by the movement of the kite which would permit an accurate timing of the movement of the kite over a given course along which such gates might be located.

SUMMARY OF THE INVENTION

A racing gate for a kite comprising an essentialy vertical pipe having means at the lower end to support the pipe from the ground, preferably by impaling, so that the gate can be movable from one location to another. An elongated wand is pivotally mounted adjacent to the upper end of the pipe and has an upper end which is adapted to project into the path of a moving kite, or more accurately into the path of the moving strings of a kite. The lower end of the wand below the pivot point is resiliently attached to the pipe so that, when the wand is pivoted by the horizontal movement of a kite string against the upper end of the wand, the wand will return to its upright position after the kite string passes by. An electrically operated timer, such as a stopwatch, is connected to the pipe. The electrical leads for the timer pass upwardly through the pipe and one of the leads is electrically connected to a conductive sleeve mounted on the wand. The other lead is connected to a second electrically conductive sleeve which is mounted on the pipe in such a position that the first sleeve will contact the second sleeve when the wand is pivoted in a given rotary direction. The resilient means is preferably mounted in such a way that the wand is offset slightly from the vertical to prevent accidental contact between the two sleeves under conditions of backlash.

DETAILED DESCRIPTION OF THE PREFERRED EMBODIMENTS

Figure 1:
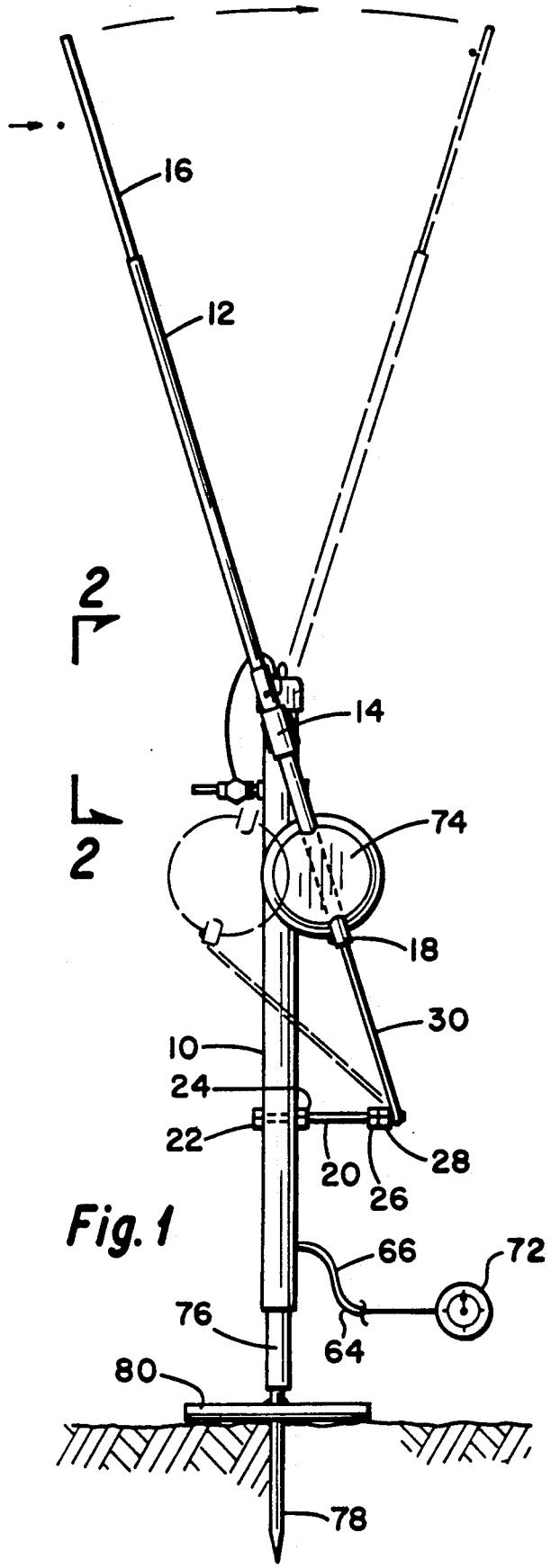
FIG. 1 is a front elevation of a kite racing gate made in accordance with a preferred embodiment of the invention.

Referring now to FIG. 1, a kite racing gate is shown as comprising a vertical standard or support which consists of a tube or pipe 10 which can be made of metal or (preferably) plastic. A vertical wand 12 is pivotally connected to the pipe 10 adjacent the upper end of the latter as at 14. The wand 12 is a hollow tube of plastic (preferably) or metal which can be provided with telescoping extensions 16 so that the effective vertical height of the wand 12 can be varied as desired. As clearly appears from FIG. 1, the pivot point 14 is above the lower end 18 of the wand 12. The lower end 18 of the wand 12 is resiliently connected to the vertical pipe 10.

A threaded rod 20 extends outwardly at right angles to the pipe 10 below the lower end 18 of the wand 12. Nuts 22 and 24 hold the rod 20 securely with respect to the pipe 10. A pair of nuts 26 and 28 are received on the outer end of the rod 20. A piece of Bungee cord 30 is to tied to the lower end 18 of the wand 12 and also to the outer end of the rod 20 beyond the nuts 26 and 28. The Bungee cord 30 is placed under tension before tying the lower end thereof to the rod 20. The nuts 26 and 28 can be moved inwardly along the rod 20 if it is desired to change the angle of the Bungee cord 30, and hence the angle of the wand 12. If desired, a spring (not shown) could be used in lieu of the Bungee cord 30. In any event, the Bungee cord connects lower end of the wand 12 resiliently to the tube 10, as indicated above. As shown in this figure, wand 12, although upright, is not precisely in a vertical position; actually the wand 12 is disposed in a slight counterclockwise position with respect to the vertical for a reason which will hereinafter appear.

Figure 3:
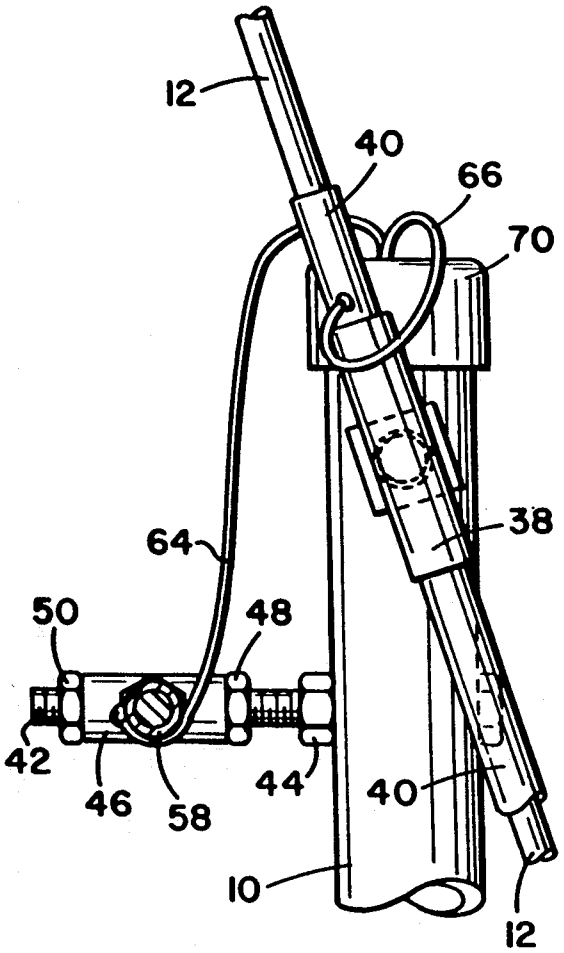
FIG. 3 is a partial front elevation looking along line 3—3 of FIG. 2.
Figure 2:
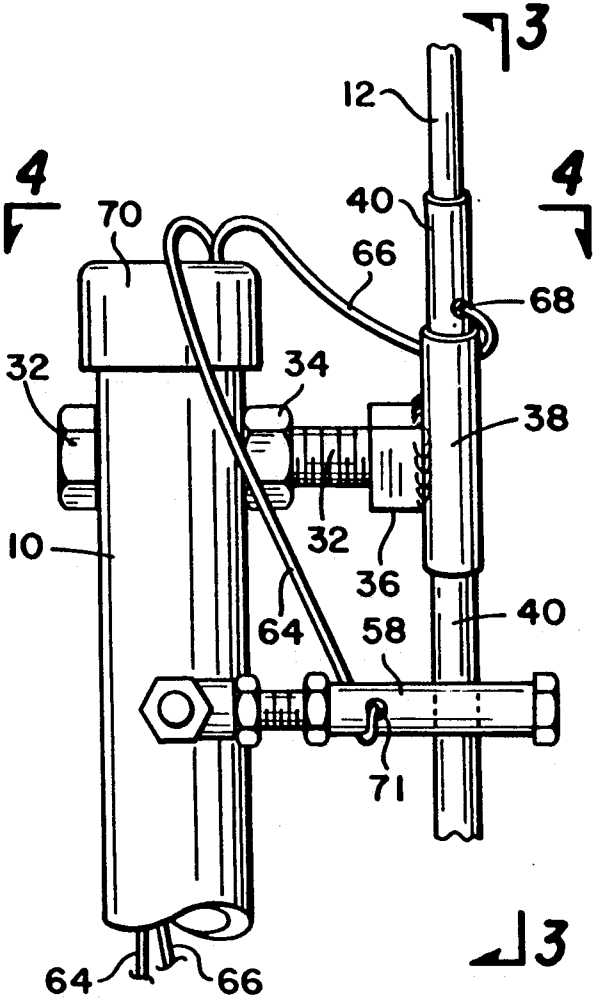
FIG. 2 is a partial side elevation, on an enlarged scale, taken along line 2—2 of FIG. 1.
Figure 4:
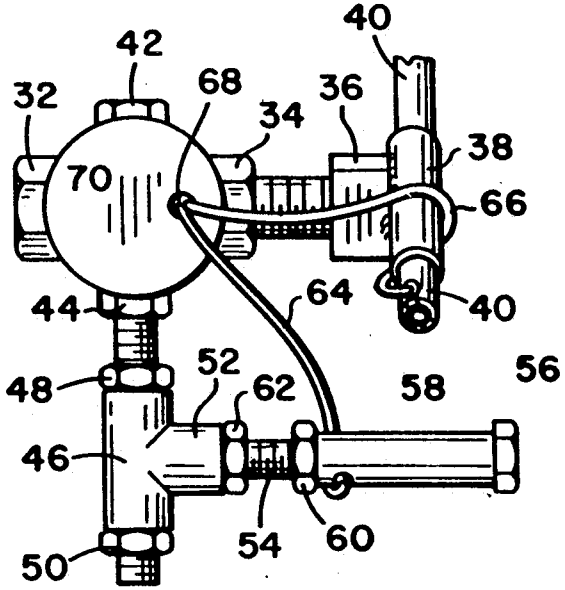
FIG. 4 is a partial plan view looking along line 4—4 of FIG. 2.

The manner in which the wand 12 is pivotally mounted with respect to the tube 10 will now be described in greater detail in relation to FIGS. 2, 3 and 4. A threaded bolt 32 passes through a pair of aligned holes (not shown) adjacent the upper end of the tube 10. The shank of the bolt 32 extends forwardly as best shown in FIG. 2. A nut 34 holds the bolt 32 snugly on the tube 10. Another nut 36 is mounted on the outer end of the bolt 32 and is welded to a metallic sleeve 38. A brass sleeve 40 is received within the sleeve 38 and extends above and below the sleeve 38. The wand 12 is snugly received within the sleeve 40.

Another bolt 42 is mounted in the pipe 10 below the bolt 32 and generally at right angles thereto. The bolt 42 is held in position on the tube 10 by means of nut 44. A hollow Tee 46 is mounted on the outer end of the bolt 42 and is held in position by means of a pair of nuts 48 and 50. The Tee 46 is provided with a right angled portion 52 which is internally threaded and which receives the shank 54 of an elongated bolt 56. A brass sleeve 58 is received on the bolt 56 and held in position by a nut 60. A lock-nut 62 will hold the bolt 56 in position with respect to the threaded portion 52 of the Tee 46.

A pair of insulated electrical leads or wires 64 and 66 extend upwardly out of a hole 68 in a cap 70 which is disposed over the upper end of the tube 10. The outer uncovered end of the lead 66 is welded to the brass sleeve 40 at 68, whereas the outer uncovered end of the lead 64 is welded to the brass sleeve 58 at 70. The leads 64 and 66 extend downwardly within the tube 10 to a location adjacent the bottom of the tube 10 where they pass outwardly through a suitable opening (not shown) and connect with a suitable timing device 72, shown diagrammatically on FIG. 1. The details of the timing device 72, or electrically operated stopwatch, are considered to be conventional and hence will not be described in greater detail. Suffice it to say, however, that the timing device 72 will be actuated, for starting or stopping purposes, whenever the brass sleeve 40 comes into contact with the brass sleeve 58. This condition would result when the wand 12 was moved in a clockwise direction to the dotted line position shown in FIG. 1. Such movement of the wand 12 could be caused by a string (or strings) of a kite moving from left to right where the strings contacted the upper end of the wand 12.

A circular member or dish 74 is mounted adjacent to the lower end of the wand 12 as best shown in FIG. 1. The dish 74 is preferably painted a bright color to provide an improved visual indication of the pivoting of the wand 12. The lower end of the tube 10 is received over a piece of metallic pipe 76 which connects with a spike 78. A cross member 80 is secured to spike 78. When it is desired to position the gate of FIG. 1 at a given location in the ground, one merely places the spike at the desired location and pushes down with his foot on the cross member 80 so that the gate is impaled into the ground.

It is contemplated that more than one gate could be employed in the sport of kite racing. That is, kites, through their strings, could actuate a plurality of gates in succession and then go back and actuate some or all of the same gates again. The gate is FIGS. 1 to 4 is one which is used to actuate a timing device 72 even though the plate 74 would provide visual indication as to when the gate has been tripped. If the gate shown in FIG. 1 is deflected by a kite string where the kite is moving from the right to the left, the wand 12 will merely move further in a counterclockwise direction and the brass sleeve 40 will not contact the brass sleeve 58; thus, in this mode of kite movement the timing device 72 will not be actuated. However, the next time that the gate of FIG. 1 is activated by a kite moving from the left to the right, the timing device 72 will be shut off, assuming that it had been turned on by a similar kite movement.

It was discovered, if the wand 12 was disposed in a precise vertical position, that backlash might cause the brass sleeve 40 to contact the brass sleewe 58 after the initial contact so as to create an error in the operation of the timer 72. Accordingly, the rod 20 is provided so that the wand 12 is intentionally disposed in a slightly counterclockwise position as shown in FIG. 1.

Figure 5:
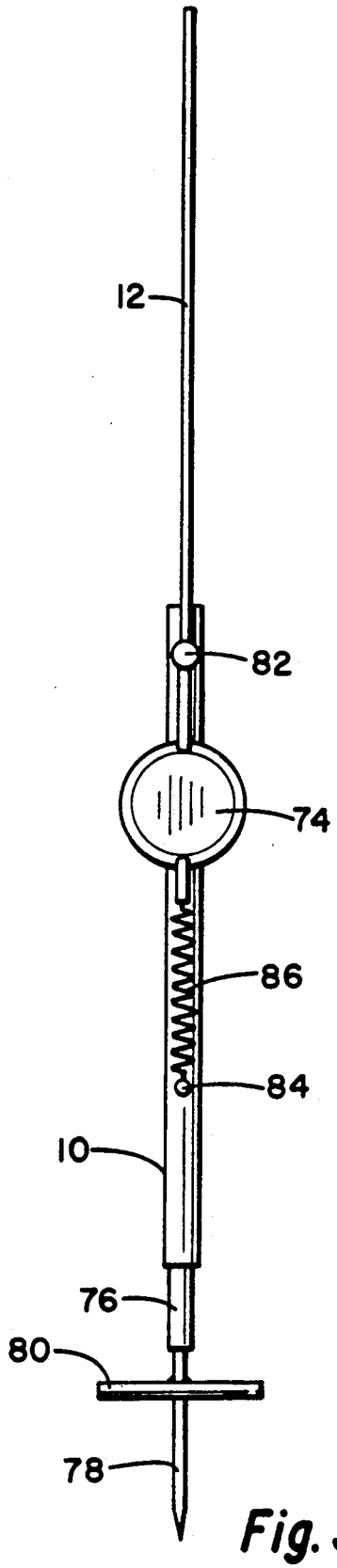
FIG. 5 is a front elevation of a simplified form of the present invention.

If the gate of FIG. 1 is used for both starting and stopping purposes, then any intermediate gates need not necessarily be provided with timing devices such at timer 72, FIG. 5 represents a simplified gate which can be used as an intermediate gate. The gate of FIG. 5 is provided with the same tube 10 and the same wand 12 which is pivotally connected to the tube 10 at location 82 in a manner similar to that described in relation to FIG. 1. However, the brass sleeve 40 has been eliminated and there is no need for the brass sleeve 58 and its supporting structure. Furthermore there is no need to cant the wand 12 in an offset condition, and therefore rod 20 can be eliminated. Thus the lower end of the wand 12 can be merely connected to a point 84 on the tube 10 by means of a spring 86 or other resilient means. The brightly colored dish 74 will still be mounted on the lower end of the wand 12 so as to provide improved visual indication of the deflection of the wand 12. The arrangement for impaling the lower end of the tube 10 of FIG. 5 will be essentially the same as that shown in FIG. 1, as indicated by the employment of the same reference numerals 76, 78 and 80.

Whereas the present invention has been described in particular relation to the drawings attached hereto, it should be understood that the other and further modifications, apart from those shown or suggested herein, may be made within the spirit and scope of this invention.

What is claimed is:

1. A gate comprising an upright standard having an upper end and a lower end, the lower end supporting the standard from the ground, an elongated wand having an upper end and a lower end, means for pivotally attaching the wand above its lower end to the standard adjacent its upper end, resilient means connected from the lower end of said wand to said standard for maintaining said wand in a normally upright condition.

2. A gate according to claim 1 wherein a signal plate is attached to said wand to facilitate visual observation of pivoting of the wand when the latter is contacted adjacent its upper end by a horizontally moving object.

3. A gate according to claim 1 wherein the lower end of the standard is provided with means for impaling the standard into the ground.

4. A gate to according to claim 1 wherein the resilient means is adapted to hold the wand in a normal position of repose which is offset from the vertical.

5. A gate according to claim 4 wherein a timing means is connected to the standard and wherein the gate is provided with actuating means responsive to the movement of the wand in a direction opposite to the direction of the offset to actuate the timing means.

6. A gate according to claim 1 wherein a timing means is connected to the standard and wherein the gate is provided with actuating means responsive to the movement of the wand to actuate the timing means.

* * * * *